United States Patent [19]

Trainor

[11] Patent Number: 4,749,058

[45] Date of Patent: Jun. 7, 1988

[54] MUFFLER

[76] Inventor: John B. Trainor, 9814 E. Navajo Pl., Sun Lake, Ariz. 85248

[21] Appl. No.: 47,184

[22] Filed: May 6, 1987

Related U.S. Application Data

[63] Continuation-in-part of Ser. No. 928,537, Nov. 7, 1986, abandoned.

[51] Int. Cl.[4] ..... F01N 1/08; F01N 7/18

[52] U.S. Cl. ..... 181/239; 181/230; 181/237; 181/243; 181/258

[58] Field of Search ..... 181/230, 237, 243, 252, 181/258, 267

[56] References Cited

U.S. PATENT DOCUMENTS

| | | | |
|---|---|---|---|
| 2,222,703 | 11/1940 | Bixler | 181/237 X |
| 2,419,664 | 4/1947 | Tabbert | 181/229 X |
| 3,208,551 | 9/1965 | Carls | 181/230 X |
| 3,339,668 | 9/1967 | Trainor | 181/237 |
| 3,561,561 | 2/1971 | Trainor | 181/267 |
| 3,680,659 | 8/1972 | Kasten | 181/230 |
| 3,718,208 | 2/1973 | Gibel | 181/267 |

FOREIGN PATENT DOCUMENTS 66955 5/1969 Fed. Rep. of Germany .

*Primary Examiner*—B. R. Fuller
*Attorney, Agent, or Firm*—Brooks & Kushman

[57] ABSTRACT

A sound attenuator may be directly threadedly connected to the exhaust port of a pneumatic device whose exhaust air is to be attenuated. A fail safe blowout plug is provided in the attenuator at the end remote from the exhaust port connection. A cartridge screen covering exhaust slots in the attenuator wall is trapped within an annular groove in the end of the attenuator remote from the exhaust port connection. The screen overlies a protective cover within the attenuator which extends over the blowout plug.

20 Claims, 2 Drawing Sheets

MUFFLER

RELATED APPLICATION

This application is a Continuation-in-Part of my earlier filed application, Ser. No. 928,537 filed Nov. 7, 1986 now abandon.

FIELD OF INVENTION

This invention relates to a sound attenuator for direct mounting on the threaded exhaust port of a pneumatic device such as an air motor or valve.

BACKGROUND OF THE INVENTION

Commercially available sound attenuators are not designed for direct mounting in the exhaust port of the device whose sound is to be attenuated, and accordingly elbows, nipples, or other extenders are generally required between the attenuator and the exhaust port. In part, at least, the reason for this is the design of the attenuator does not lend itself to the confined area often surrounding the exhaust port of the pneumatic device.

One of the problems in providing an attenuator for direct mounting in the exhaust port of a pneumatic device is that if provision is made for a blowout plug, the plug must be able to blow out of the attenuator without interference from the device on which the attenuator is mounted, such as an adjacent wall or other surface. In existing attenuators, the blowout plug has been mounted in the end wall which lies adjacent the pneumatic device on which the attenuator is mounted, and thus extenders or the like are required in order to mount the attenuator spaced from the pneumatic device sufficiently so that the fail safe plug could below out without interference. In addition, locating the fail safe plug in the end of the attenuator adjacent the exhaust port, necessitated the attenuator having a sufficiently large diameter to accommodate the plug, and this often interfered with adjacent wall portions or surfaces of the pneumatic device, thereby requiring extenders or the like to space the attenuator from the pneumatic device so that it could be mounted thereon.

SUMMARY OF THE INVENTION

I have conceived of an attenuator for the exhaust port of pneumatic devices which may be directly threadedly connected to the exhaust port without intervening extenders, couplers or the like, and which is nevertheless provided with a fail safe blowout plug. My design may be of smaller diameter than the prior art alternators so that it may be received in the often confined areas surrounding the exhaust port of the pneumatic device on which the attenuator is to be mounted. The blowout plug is located at the opposite end of the attenuator from the exhaust port in which the attenuator is mounted, and yet exhaust air is prevented from direct impringement on the blowout plug so that the plug is not inadvertently dislodged from its normal position. The design is such that the attenuator may be readily dissambled for removal, replacement and/or cleaning of the screen cartridge and the end of the screen is trapped within the structure of the attenuator walls so that it is not dislodged or torn up by the exhausting air.

DESCRIPTION OF THE PREFERRED EMBODIMENTS

Figure 1:
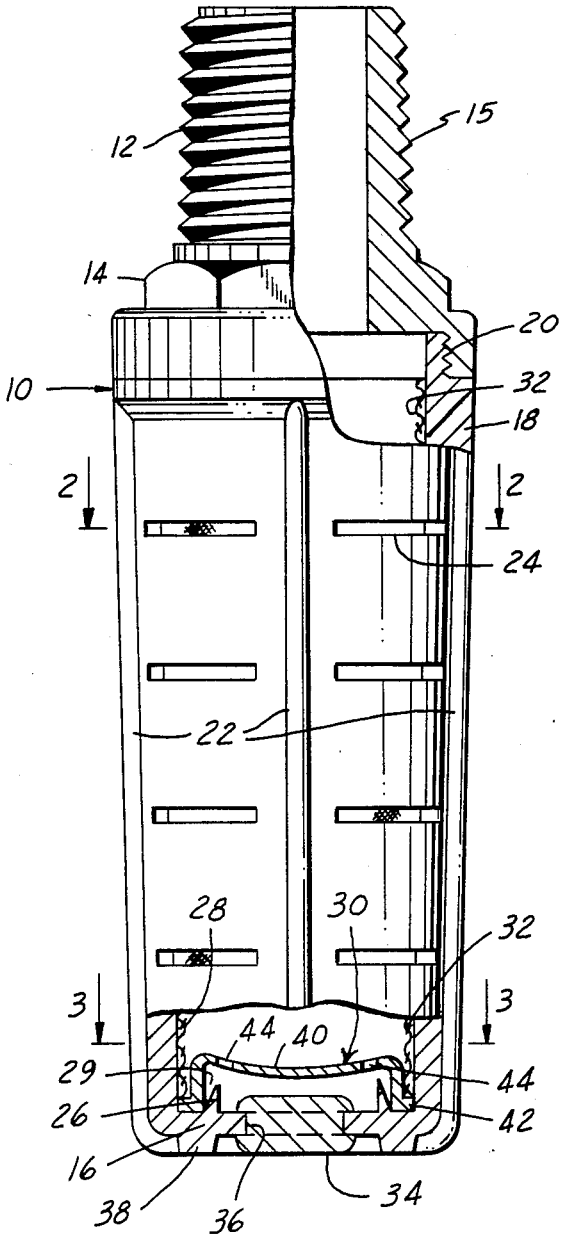
FIG. 1 is a side elevation partially in section of one embodiment of the sound attenuator of this invention.
Figure 2:
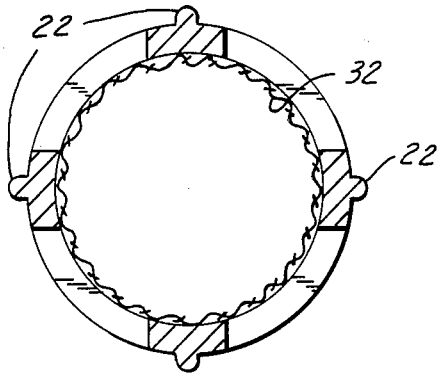
FIG. 2 is a cross sectional view taken on the line 2—2 of FIG. 1.
Figure 3:
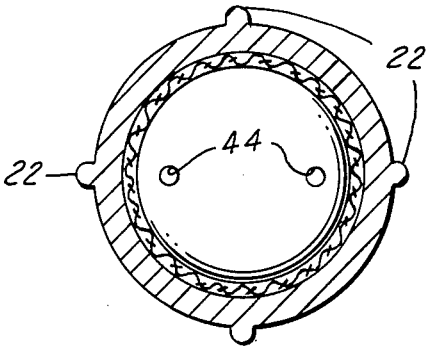
FIG. 3 is a cross sectional view taken on the line 3—3 of FIG.1.

A first embodiment of my sound attenuator is shown in FIG. 1 and comprises a hollow tubular body 10 having a threaded projection 12 at one end for screw threaded connection to the exhaust port (not shown) of a pneumatic device whose exhaust is to be attenuated. The tubular body is preferably formed of plastic such as a filled polyproplene. Other plastics may also be found suitable and the invention is not intended to be limited to one particular plastic composition. The threaded projection 12 may be provided with a peripherally extending wrench engaging surface 14. The threads 15 of the projection may be pipe threads so that the attenuator may be fluid tightly locked in the exhaust port. The opposite end of the tubular body is closed by a transversely extending end wall 16.

The tubular body 10 includes a tubular wall portion 18 which is of larger diameter adjacent the threaded projection end 12 than adjacent the transverse wall 16, and the tubular wall is externally threaded to be threadedly, removably connected to an internal thread of the threaded projection as at 20. The transverse end wall 16 is integral with the tubular wall 18. The exterior of the tubular wall portion is provided with axially extending circumferentially spaced apart ribs 22. The tubular wall is also provided with transverse exhaust slots or vents 24 opening from the interior of the tubular body to the exterior thereof. The slots are arranged between the ribs in columns as best shown in FIG. 1.

The transverse wall 16 is provided with an annular axially inwardly extending shoulder 26 spaced radially inwardly from the inner wall surface 28 of the tubular wall portion 18 to provide an annular groove 29 within which is received a protective cover 30 and the end of the screen cartridge 32. The protective cover 30 overlies in spaced relation a fail safe blowout plug 34 of resilient material which is received in a provided aperture 36 in the transverse wall 16. An annular reinforcing rib 38 is integrally molded with the transverse wall 16 in surrounding spaced relation from the blowout plug 34. This rib extends below the outer surface of the plug to protect it from accidentally being pushed into or pulled out of the muffler.

The protective cover 30 is of generally hat-shaped configuration having a concavo-convex crown portion 40 and a peripheral rim portion 42 which is received within the annular groove 29. The screen 32 bears against the brim portion of the cover as best shown in FIG. 1 to hold the protective cover against the transverse wall 16 in position above the blowout plug 34. The screen 32 may be either a multiple layered brass wire cloth welded to provide a cylindrical shape or any other suitable filtering media. The protective cover includes apertures 44 allowing fluid pressure communication between the interior of the tubular body and the blowout plug. The concave surface of the protective cover which faces toward the threaded projection 12 serves to redirect impinging exhaust air toward the encircling side wall surface 28 and against the screen 32. The exhaust air, of course, escapes through the screen 32 and the slots 24 outwardly of the attenuator after the velocity of the exhaust air has been reduced to the point where the noice level is substantially diminished.

It will be noted that the attenuator may be disassembled by gripping the ribs 22 while holding the threaded projection 12 stationary and rotating the tubular wall 18 to disconnect the threaded connection 20 between the tubular wall and the threaded projection. Upon disassembly the screen cartridge 32, which is formed on a taper corresponding to the taper of the tubular wall 18, and bridges over the slots 24 and lies flush against the wall surface 28, may be removed for cleaning and/or replacement.

It will be noted that the end of the screen 32 is trapped between the crown 40 of the hat-shaped protective cover and the encircling wall surface 28 of the tubular wall 18 whereby the end of the screen cartridge is protected against exhaust air getting beneath it and tearing or otherwise distorting the screen.

The blowout plug 34 is intended to be expelled from its aperture 36 should there be an unusual back pressure created within the attenuator, either as a result of blockage of the screen 32 or slots 24 or an unusually large amount of exhaust air being expelled into the attenuator. In either event, the fail safe plug 34 is intended to prevent explosion of the attenuator. By being located as shown in the embodiment of FIG. 1, the plug will be readily visible upon inspection if it is in place or its absence will be immediately noticed.

Figure 4:
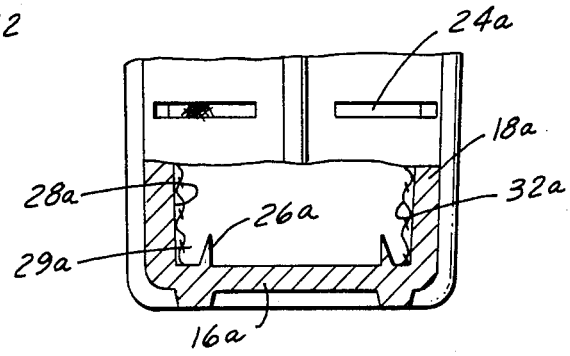
FIG. 4 is a fragmentary cross sectional view through a modified form of the embodiment of FIG. 1.

In FIG. 4 I have shown a modification of the embodiment of FIG. 1. Like reference numerals with alphabetic suffix indicate like parts. The transverse wall **16*a* is not provided with the aperture 36 for reception of a blowout plug. Other than this, the transverse wall 16*a* corresponds to that of the embodiment of FIG. 1. The screen 32*a* is received in the annular groove 29*a* between the annular wall 26*a* and the encircling wall surface 28*a* of the tubular wall 18*a*** to prevent the end of the screen cartridge from being disturbed by the exhaust air passing through the attenuator.

Figure 5:
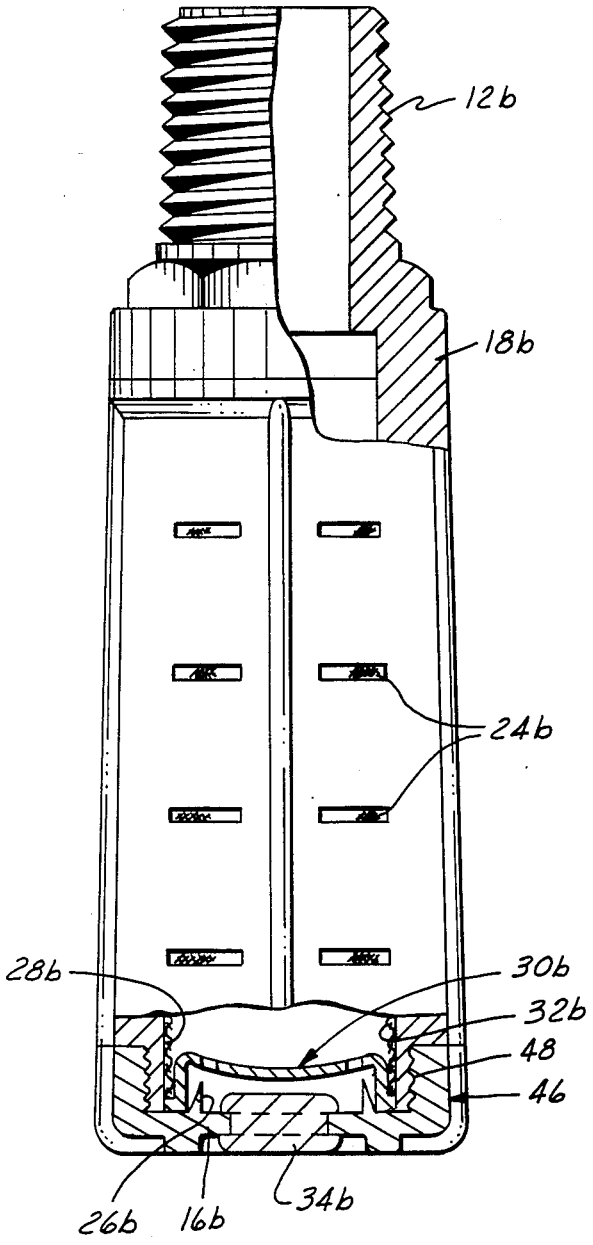
FIG. 5 is a side elevation, partially in section, of a third embodiment of the invention.

In FIG. 5 I have shown a third modification of the invention in which the screw threaded projection **12*b* is integral with the tubular wall 18*b* while the transverse wall 16*b* is part of a cup-shaped end closure 46 which is threadedly connected to the distal end of the tubular wall 18*b* at 48. For this purpose the cup-shaped closure may be internally threaded while the tubular wall 18*b* is externally threaded and the two parts screwed together. This embodiment also differs from that of FIG. 1 in that the diameter of the tubular wall 18*b* is smaller adjacent the threaded projection 12*b* than adjacent cup-shaped end closure 46 to facilitate molding of the muffler. Other than these differences, the modification of FIG. 5 corresponds in all respects to that of FIG. 1 and includes, as shown, the fail safe plug 34*b*, annular wall 26*b*, etc. The screen 32*b* will have, as with the screen in the FIG. 1 embodiment, a taper which corresponds to the taper of the tubular wall and will lie closely adjacent the inner wall surface 28*b* and bridge across the slots 24*b*. The screen cartridge 32 or 32*b*** comprises a cylinder of wire screen which is slightly compressed radially when disposed within the tubular body.

Figure 6:
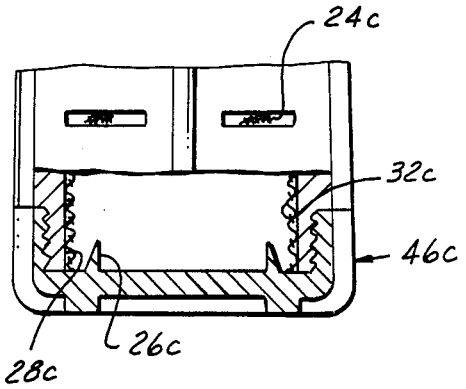
FIG. 6 is a fourth embodiment of the invention constituting a modification of the embodiment of FIG. 5.

In FIG. 6 I have shown a modification of the embodiment of FIG. 5 in which the fail safe blowout plug **34*b* has been omitted along with the aperture 26*b* from the internally threaded cap 46*c*. Also omitted is the protective cover 30*b*. The lower end of the screen 32*c* is received in the annular groove between the wall 26*c* and the encircling wall 28*c* as in the arrangement of FIG. 4**.

The design shown in FIGS. 1–6, by placing the blowout plug at the opposite end of the attenutor from the threaded projection, has enabled a slimming up of the overall shape and design of the attenuator, thereby enabling the threaded projection to be directly screw threaded into the exhaust ports of many pneumatic devices on which such an attenuator may be mounted and accordingly reduces the cost for the installation of this attenuator as compared with prior art attenuators.

I claim:

1. A sound attenuating device for direct mounting in the threaded exhaust port of a pneumatic device comprising, in combination:

a hollow tubular body having a threaded projection at one end for screw threaded connection to an exhaust port of a pneumatic device to establish fluid communication therewith, and closed at the opposite end by a transversely extending end wall;

said tubular body tapering from a larger diameter at one end to a smaller diameter at the other end;

exhaust vents extending transversely through the tubular body;

said transversely extending end wall defining an annular groove within the tubular body;

a tubular screen disposed in the tubular body and having a taper corresponding thereto and bridging across said exhaust vents with one end of the screen disposed adjacent said threaded projection and the opposite end disposed within said annular groove, trapping such end against dislocation;

a blowout plug disposed in said transversely extending end wall; and a protective cover disposed in said tubular body and overlying the blowout plug to prevent direct impingement thereon of exhaust gas entering the tubular body through said threaded projection.

2. The invention defined by claim 1 wherein said threaded projection is removably mounted to the tubular body.

3. The invention defined by claim 1 wherein said transversely extending end wall is removably mounted to the tubular body.

4. The invention defined by claim 1 wherein an end of said screen overlies and bears against said protective cover and is disposed between the cover and an encircling wall of the tubular body.

5. The invention defined by claim 1 wherein said blowout plug is formed of resilient material.

6. A sound attenuating device for direct connection in the threaded exhaust port of a pneumatic device comprising, in combination:

a hollow tubular device having a threaded projection at one end for screw threaded connection to an exhaust port of a pneumatic device to establish communication therewith;

said tubular body having a tubular wall with exhaust vents opening laterally therethrough;

a cylindrical screen in the tubular body overlying the inner surface of the tubular wall and bridging across said vents;

a blowout plug at the end of the tubular body opposite the threaded projection; and a blowout plug protection cover disposed in the tubular body and overlying the blowout plug.

7. The invention defined by claim 6 characterized by said blowout plug being formed of a resilient material.

8. The invention defined by claim 6 wherein said cover is provided with vent means therethrough permitting fluid communication between the interior of the tubular body and the blowout plug.

9. The invention defined by claim 8 wherein said vent means in the cover is arranged to prevent direct impingement upon the blowout plug of fluid pressure exhaust entering the tubular body.

10. The invention defined by claim 6 wherein said protection cover has a concavo-convex shape spanning over the blowout plug.

11. The invention defined by claim 10 wherein the concave side of the cover faces inwardly of the tubular body and the convex side faces the blowout plug.

12. The invention defined by claim 6 wherein said cylindrical screen at one end bears against the protection cover to hold the latter in position over the blowout plug.

13. The invention defined by claim 12 wherein said protection cover is generally hat-shaped with the hat brim portion bearing against the interior surface of the tubular wall, and with said cylindrical screen disposed between the hat crown and interior surface of the tubular wall and bearing against the hat brim.

14. The invention defined by claim 6 wherein that end of the tubular body opposite the threaded projection is internally provided with an annular groove and an end of the cylindrical screen is received in said groove.

15. The invention defined by claim 14 wherein said annular groove surrounds the blowout plug.

16. The invention defined by claim 14 wherein said cover is generally hat-shaped and the hat brim portion is disposed in said groove and the cylindrical screen bears against the hat brim portion holding it in said groove.

17. The invention defined by claim 6 wherein said threaded projection comprises an end wall of the tubular body interfitted with the tubular wall and supporting the same for mounting on a fluid pressure device whose exhaust is to be attenuated.

18. The invention defined by claim 17 wherein the end of the tubular body opposite the threaded projection comprises a transverse wall portion integral with the tubular wall, and said tubular wall tapers from a smaller diameter adjacent said transverse wall to a larger diameter adjacent the opposite end.

19. The invention defined by claim 6 wherein said threaded projection is integral with the tubular wall and the opposite end of the tubular body is closed by an interfitting transverse wall portion carrying said blowout plug.

20. The invention defined by claim 19 wherein said tubular wall tapers from a larger diameter adjacent said transverse wall to a smaller diameter adjacent the threaded projection.

* * * * *